United States Patent [19]

Fullman

[11] 4,417,927

[45] Nov. 29, 1983

[54] STEEL NITRIDING METHOD AND APPARATUS

[75] Inventor: Robert L. Fullman, Schenectady, N.Y.

[73] Assignee: General Electric Company, Schenectady, N.Y.

[21] Appl. No.: 363,330

[22] Filed: Mar. 29, 1982

[51] Int. Cl.[3] ..... C21D 1/48

[52] U.S. Cl. ..... 148/16.6; 148/20.3

[58] Field of Search ..... 148/16.6, 16.0, 20.3

[56] References Cited

U.S. PATENT DOCUMENTS 3,684,590 8/1972 Podgurski ..... 148/16.6

4,003,764 1/1977 Wunning ..... 148/16.6

FOREIGN PATENT DOCUMENTS 621890 4/1949 United Kingdom ..... 148/16.6

*Primary Examiner*—John P. Sheehan

*Attorney, Agent, or Firm*—Leo I. MaLossi; James C. Davis, Jr.; James Magee, Jr.

[57] ABSTRACT

Ammonia is used in the hardening of steels in a nitriding process which is controlled to limit or prevent formation of undesired iron nitrides by measuring the difference between input and output gas flow rates to and from the nitriding chamber and adjusting the input gas composition and/or flow rate in response to that difference to provide a predetermined desired composition of the nitriding atmosphere in the chamber.

11 Claims, 4 Drawing Figures

FIG. 1
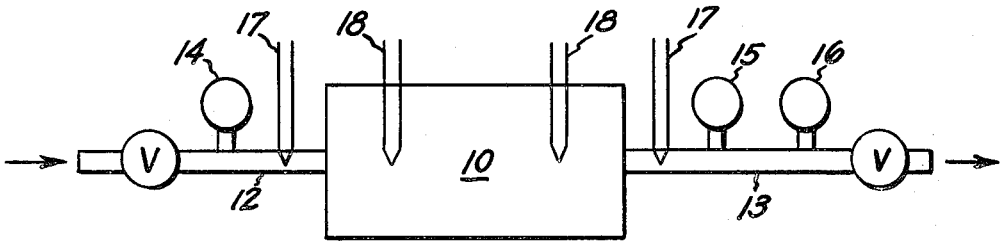
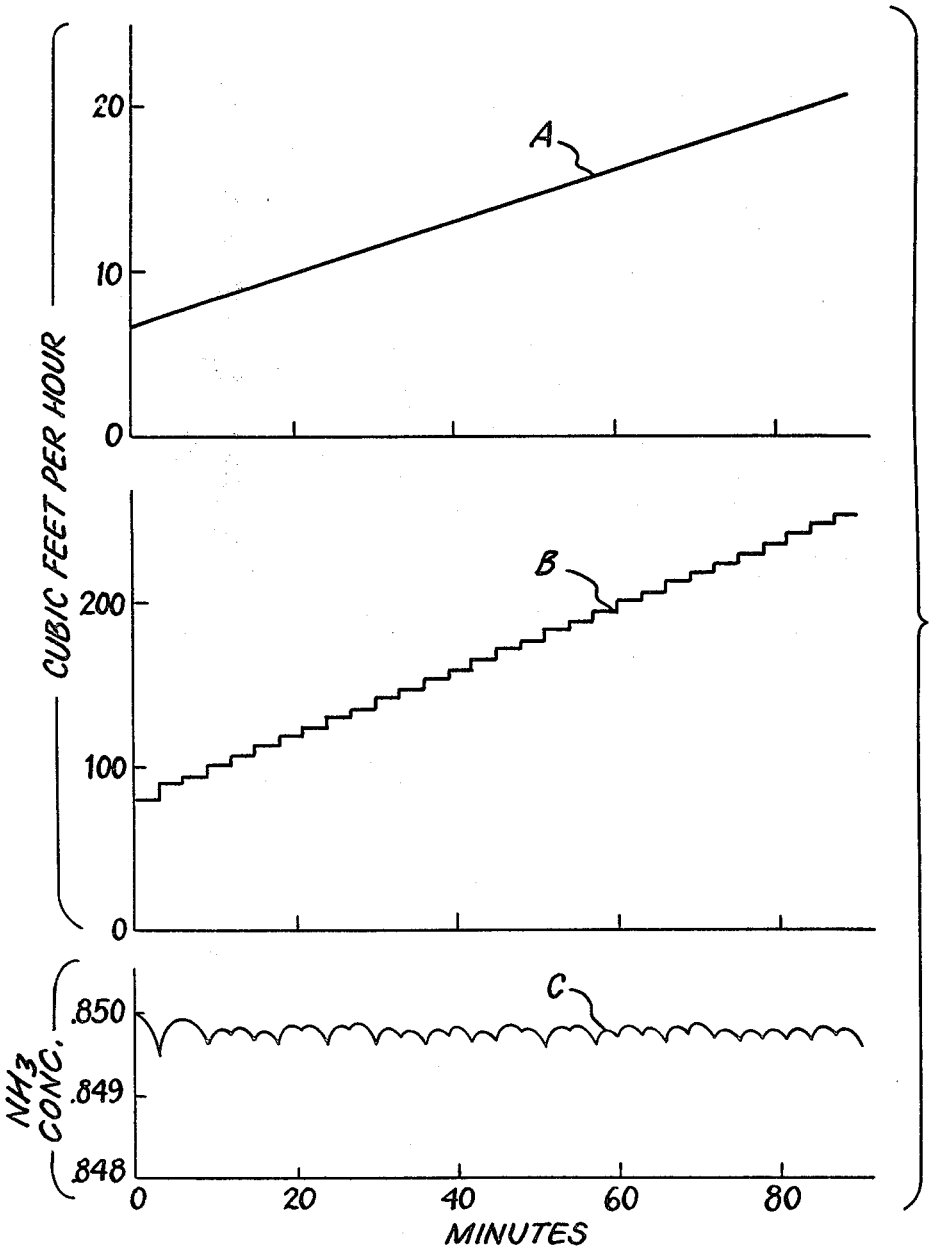
FIG. 2

STEEL NITRIDING METHOD AND APPARATUS

The present invention relates generally to the art of nitriding steel with ammonia and is more particularly concerned with a novel method in which nitrogen activity is controlled to limit or prevent iron nitride formation, and is additionally concerned with unique apparatus implementing that method.

BACKGROUND OF THE INVENTION

Hardening of steels by nitriding through the use of ammonia is a long-standing commercial production practice. Typically, this method is used to harden only a thin layer at the surface of the steel body or workpiece, i.e., case hardening, to impart, for example, wear resistance. The scientific fundamentals have in fact been known for somewhat more than 50 years and the method presently widely used was introduced into large-scale operations in the late '20's. In accordance with that method, an ammonia-containing atmosphere is flowed in contact with a steel workpiece at elevated temperature under conditions favoring formation of nitrides of aluminum, titanium, chromium and other stable nitride-forming alloying elements of the steel, typically as a dispersion of particles of the nitride or nitrides in the steel matrix.

Suitability of the nitriding atmosphere is determined periodically by sampling gasses flowing out of the nitriding chamber and measuring their ammonia content; commonly, for example, by means of a gas burette which measures the fraction of the gas which is soluble in water. These chemical-type tests afford indications of the thermodynamic activity of nitrogen, which is porportional to the ratio $pNH_3/pH_2^{3/2}$, where $pNH_3$ and $pH_2$ represent the partial pressures of ammonia and hydrogen in the gas. A common objective in controlling the process is to limit the thermodynamic activity of nitrogen so as to form few or no weak and brittle iron nitrides, but within that limitation to maintain the nitrogen activity at a high enough level to enhance the rate of nitrogen diffusion into the iron lattice, and thereby optimize the size of the nitride particles of aluminum and other alloying elements. Since the dissociation of ammonia is catalyzed by the steel being nitrided and by other metal surfaces in the nitriding chamber, and since the catalytic effectiveness of these surfaces changes during the nitriding process, repeated testing of the ammonia concentration in the gas is required during the course of the nitriding process.

This chemical-type process control does not provide a quantitative guide for changing input gas composition or process variables in immediate response to changes in the catalytic activity of surfaces in the nitriding chamber or retort. Nevertheless, this still is the generally used control procedure in steel nitriding operations.

SUMMARY OF THE INVENTION

By virtue of this invention, based on my new concept set out below, the steel nitriding process can be more precisely controlled at every stage than was possible heretofore. Moreover, this invention affords the opportunity for enhanced precision of automatic control of this nitriding process from beginning to end. In particular, that concept is that the difference between the flow rates of gasses into and out of the nitriding retort or chamber provides a measurement of the rate at which ammonia as the active constituent of the nitriding gas is being dissociated in the retort. Further, according to this concept, comparison of the current dissociation rate with the dissociation rate that would at steady state maintain the current ammonia partial pressure in the gas provides a prediction of gas composition changes and a guide for changing process variables so as to maintain constant gas composition (or make desired changes) responding virtually immediately to changes in the catalytic activity of surfaces in the retort which may result from progress of the nitriding process, or from temperature changes, or both.

Since each mole of ammonia that dissociates forms two moles of products, the output gas flow rate will exceed the input gas flow rate by an amount related to the rate of ammonia dissociation, if the retort temperature and total gas pressure are constant. If the retort temperature and/or total gas pressure are not constant, their rate of change may be measured, and that information also used in the determination of the rate of ammonia dissociation. Further, it is not necessary as a practical matter to consider either the gas fraction absorbed by the nitrided steel or the furnace parts, both being trivial in respect to assessment of the rate of ammonia dissociation by output or effluent minus input or influent gas flow rate difference. Still further, normally available accuracy of temperature and gas pressure measurement are sufficient to permit a usefully accurate assessment of the rate of ammonia dissociation.

Briefly described in its method aspect, the present invention involves the method of controlling the gas nitriding process wherein an influent gaseous atmosphere enters a nitriding chamber and flowingly contacts as the nitriding atmosphere at least one steel body at an elevated temperature in the nitriding chamber and an effluent gas exits the nitriding chamber, which comprises the steps of (a) monitoring the ammonia dissociation rate by measuring the difference between the flow rates of the influent and effluent gasses and (b) adjusting the nitriding conditions in response to the difference between the flow rates of the influent and effluent atmospheres in order to provide a predetermined desired composition of the nitriding atmosphere in the chamber. Those adjustments may be made in qualitative fashion, i.e., by an operator, or in quantitative fashion in the preferred and optimized embodiment, i.e., by automated means.

Likewise described in its most general terms, the apparatus of this invention comprises (a) a chamber for receiving and heating at least one steel workpiece in the presence of a flowing gaseous nitriding atmosphere, (b) input means for conveying an influent gas atmosphere into the chamber, (c) exhaust means for conveying an effluent gaseous atmosphere out of the chamber, (d) means for determining the difference between the rates of flow of the influent and effluent gaseous atmospheres and (e) means for adjusting the nitriding conditions in response to the flow rate difference to provide a predetermined desired composition of the nitriding atmosphere in the chamber.

BRIEF DESCRIPTION OF THE DRAWINGS

FIG. 1 is a diagrammatic view of steel nitriding apparatus of this invention.

FIGS. 2 and 3 are charts on which effluent minus influent gas flow rate difference, influent gas flow rate, and ammonia mole fraction in the retort gas are plotted against time in minutes, the curves representing process information, responsive control steps, and expected results attained by the practice of this invention under hypothesized circumstances described below.

DETAILED DESCRIPTION OF THE INVENTION

Figure 4:
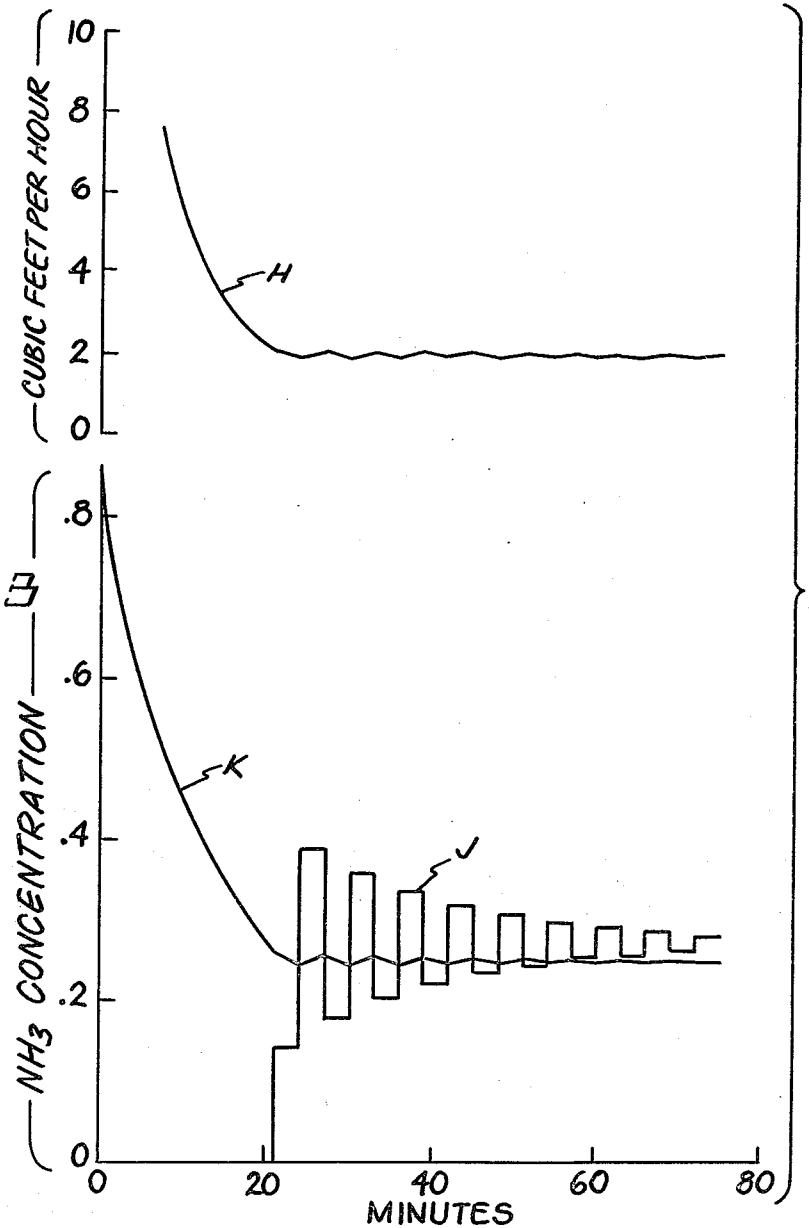
FIG. 4 is a chart on which effluent minus influent gas flow rate difference, and the ammonia mole fraction in influent gas and in the retort gas are plotted against time in minutes, the curves representing process information, responsive control steps, and expected results attained by the practice of this invention under hypothesized circumstances described below.

In carrying this invention into practice, steel articles to be nitrided are placed in the usual manner in a retort 10 having nitriding gas delivery and exhaust lines 12 and 13, respectively; valves, V, for gas flow control in and out of retort 10; device 16 for measuring the ammonia concentration of the retort gas; one or more devices 17 and 18 for measuring the external and retort gas temperatures, respectively; and being basically the same in design and construction as retorts for the same purpose in general use in steel nitriding operations. Unlike such previously known equipment, however, the apparatus of this invention includes meters 14 and 15 in lines 12 and 13, respectively, for measurement of the gas flow rates into and out of retort 10 during progress of the nitriding operation.

At the outset, workpieces in retort 10 are brought to the predetermined desired temperature by heating the retort suitably in the usual manner, nitriding gas is delivered continuously into retort 10 and effluent is continuously discharged from retort 10 to maintain substantially constant flow of nitriding gas in contact with the heated workpieces. The process is conducted in accordance with a specified sequence of temperatures, times and ammonia concentrations in the retort gas, which may differ for various steel compositions as well as various desired properties and thickness of the resulting nitrided layer. The sequence is sometimes designed to provide a relatively high thermodynamic activity of nitrogen early in the process, so that the rate of nitrogen diffusion into the steel is enhanced, and to provide a relatively lower activity of nitrogen later in the process, so that iron nitride formed in the earlier stages is dissociated to provide a continuous source of nitrogen for further diffusion.

For example, during the initial stage of the process, the retort temperature might approximate 900° F. (755° K.) with an ammonia partial pressure of about 0.85 atmosphere. Then, during middle and late stages, the temperature might be increased to about 950° F. (783° K.) and then to about 1070° F. (850° K.) with the ammonia partial pressure reduced to about 0.15 atmosphere. Also at the outset, the input gas might be pure ammonia. Steady state operation at desired ammonia partial pressures in retort 10 might be established by adjusting the rate at which nitriding gas of fixed ammonia concentration is delivered into retort 10, or by adjusting the input ammonia concentration, or both.

As nitriding proceeds, catalytic activity of the steel and other metal surfaces in the retort may change requiring further adjustments in one or more of the processing conditions. In conventional control of the process, changes in the input gas flow and/or ammonia concentration are generally made in accordance with operator experience in response to departures of the measured retort ammonia concentration from its desired level at any stage of the process. In contrast, control of the nitriding process in accordance with the methods of this invention may readily and accurately be automated, since the measured gas flow rate difference provides explicit information for control over the input variables required for adjustment of the retort atmosphere. Actually, various control strategies might be programmed in order to select the concentration of ammonia in the input gas and/or changes in rate of flow of input gas during the approach to the desired ammonia concentration level in the retort.

The manner in which information concerning the difference between nitriding gas flow rates into and out of the nitriding retort is used for control of the nitriding process will be clarified by consideration of the following equations, relating those flow rates to the rate of ammonia dissociation in the retort, and thereby to the trend of ammonia concentration in the retort gas.

As a result of the reaction $$NH_3 \rightarrow \tfrac{1}{2}N_2 + (3/2)H_2$$

two moles of gaseous products are formed for each mole of ammonia that dissociates. As a result, the molar gas flow rates into and out of the retort depend on the rate of ammonia dissociation and the retort temperature and/or pressure in accordance with the relationship of Equation 1:

$$\dot{n}_{out} = \dot{n}_{in} + j_{NH3} - \dot{n}_r \qquad \text{Equation 1}$$

where $\dot{n}_{out}$ and $\dot{n}_{in}$ are the molar flow rates of nitriding gasses from and into the retort, respectively, $j_{NH3}$ is the rate of ammonia dissociation, and $\dot{n}_r$ is the rate of change of the moles of gas contained in the retort, as a result of any changes in retort temperature and/or pressure. Assuming ideal gas behavior, substantially uniform and constant gas pressure, and neglecting thermal expansion of the retort volume in comparison to the much larger thermal expansion of gases, Equation 1 can be expressed in terms of volumetric measurements and rearranged as Equation 2 to provide an expression for the ammonia dissociation rate in terms of nitriding gas flow rates and the rate of change of the retort temperature:

$$j_{NH3} = \frac{P}{RT_a}\left[(\dot{V}_{out} - \dot{V}_{in}) - \frac{V_r T_a}{T_r 2}\dot{T}_r\right] \qquad \text{Equation 2}$$

where:

R = ideal gas constant, in units consistent with the volume and temperature units used;

$\dot{V}_{in}$ = flow rate of gas into the retort;

$\dot{V}_{out}$ = flow rate of gas from the retort;

$V_r$32 volume of gas contained in the retort;

$T_a$ = absolute temperature of gas where volumetric flow rates are measured;

$T_r$ = absolute temperature of retort gas;

$\dot{T}_r$ = rate of change of $T_r$; and

P = gas pressure throughout the nitriding system.

Knowledge of the ammonia dissociation rate in turn permits determination of the rate of change of ammonia concentration in the nitriding gas. The rate of change of the number of moles of ammonia contained in the retort is $$\dot{n}_{NH3} = X_o\dot{n}_{in} - X\dot{n}_{out} - j_{NH3} \qquad \text{Equation 3}$$

where $X_o$ is the molar concentration of ammonia in the input gas, and X is its molar concentration in the retort.

The rate of change of molar concentration of ammonia in the retort is $$\dot{X} = \frac{\dot{n}_{NH3} - X\dot{n}_r}{n_r} \quad \text{Equation 4}$$

Combining Equations 2, 3 and 4 and converting to volumetric units, $$\dot{X} = \frac{T_r}{T_a V_r}[(X_o - X)\dot{V}_{in} - (1 + X)\Delta] + (1 + X)\frac{\dot{T}_r}{T_r} \quad \text{Equation 5}$$

where $\Delta = \dot{V}_{out} - \dot{V}_{in}$.

Equation 5 may be rearranged as follows as Equation 5a, $$(X_o - X)\dot{V}_{in} = (1 + X)\Delta + \frac{T_a V_r}{T_r}\left[\dot{X} - (1 + X)\frac{\dot{T}_r}{T_r}\right] \quad \text{Equation 5a}$$

which expresses the input parameters, $X_o$ and/or $\dot{V}_{in}$, that will change the ammonia concentration in the retort at a rate $\dot{X}$.

For quantitative automated control purposes $\dot{X}^*$, the selected rate of approach of the ammonia concentration in the retort (X) toward the desired ammonia concentration in the retort ($X^*$) is substituted for $\dot{X}$ in Equation 5a to yield equation 5b as follows:

$$(X_o - X)\dot{V}_{in} = (1 + X)\Delta + \frac{T_a V_r}{T_r}\left[\dot{X}^* - (1 + X)\frac{\dot{T}_r}{T_r}\right] \quad \text{Equation 5b}$$

The selected rate of approach $\dot{X}^*$, is a function chosen in accordance with elementary control theory, but a simple linear relationship, such as $\dot{X}^* = B(X^* - X)$, where B is a constant, should be satisfactory for most applications.

Those skilled in the art will gain further and better understanding of this invention and appreciation of its new advantages upon consideration of the following illustrative, but not limiting, examples (i.e. EXAMPLES I, II, III and IV) simulating the practice of this invention on a commercial scale.

In order to simulate the results of controlling the nitriding process in accordance with this invention, changes in the nitriding gas composition will be calculated for these examples assuming a particular relationship between the rate of ammonia dissociation and the composition of the nitriding gas approximately as observed by Winter—Z. physikal Chem. 13B 401-423 I (1931)—for experiments using iron catalysts:

$$j_{NH3} = \frac{K'Sp\mathrm{NH_3}}{p\mathrm{H_2}^{1.5}} \quad \text{Equation 6}$$

where K' is a constant reflecting the catalytic activity of surfaces with area S in the retort. In the examples it will be assumed that the input nitriding gas is either pure ammonia or a mixture of ammonia and dissociated ammonia, and that the gas pressure throughout is one atmosphere. Under these assumptions, the ammonia partial pressure equals its molar concentration X and Equation 6 may be rewritten as Equation 6a $$j_{NH3} = \frac{KSX}{(1 - X)^{1.5}} \quad \text{Equation 6a}$$

where $K = 0.75^{-1.5}K'$. It will be further assumed that K has a temperature dependence described by a relationship of the type $$K = K_o \exp(-Q/RT) \quad \text{Equation 7}$$

as reported by Winter, where $K_o$ is a temperature-independent parameter which may change with progress of the nitriding process, R is the ideal gas constant, and the activation energy Q is assumed to be constant. The composition-dependence and temperature-dependence of the ammonia decomposition rate given by Equations 6, 6a and 7 are assumed for purposes of simulating the operation of this invention in the examples which follow, but the operation of the invention is not considered to be dependent on the validity of these relationships.

EXAMPLE I

Assuming a retort of 100 cu.ft. volume with the retort and both input and output flowmeters at a pressure of substantially one atmosphere, and assuming an ambient temperature of 70° F. (294° K.), the retort temperature is raised with the workpieces in place in the retort to 900° F. (755° K.), the input nitriding gas is pure ammonia and, at the outset of the process, the mole fraction of ammonia in the retort in contact with the heated metal is to be at its desired value, say at 0.85. Suppose that the flow rate of ammonia into the retort is 60 cu.ft./hr. while flow rate of gas out of the retort is 66½ cu.ft./hr. This flow rate difference would indicate a rate of ammonia dissociation that is too high to maintain the desired ammonia concentration. In particular, for a constant retort temperature, a value for the rate of change of the mole fraction of ammonia in the retort gas of −0.078 per hour, as indicated by Equation 5, would be expected.

Then, in accordance with Equation 5a, for constant retort gas temperature calculation of, the volumetric flow rate of the gas flowing into the retort that will maintain X at the initial 0.85 value would be 80 1/6 cu.ft./hr.

In response to that information, suppose the controller then increases the input gas flow rate to an 80 cu.ft./hr. level, the flow rate of the output from the retort becomes 86½ cu.ft./hr. and, in accordance with Equation 5, the steady state condition desired at this point in the operation of the process is retained, with the rate of change of the mole fraction of ammonia in the retort being −0.0006 per hour, which is essentially zero.

EXAMPLE II

This example illustrates how control of the nitriding process in accordance with this invention is proposed to maintain the retort gas ammonia concentration in close approximation to its desired value despite continuing changes in the catalytic activity of the steel and other metal surfaces in the retort. For purposes of this example, it will be assumed that the rate of ammonia dissociation follows the relationship given in Equations 6 and 6a, and that the catalytic activity increases at a constant rate such that $K'S=(0.3387+0.50t)$ moles $hr^{-1}atm^{\frac{1}{2}}$, where t is the time in hours since the start-up described in Example I. Using the same values for the other variables as in Example I, Equation 6a was combined with Equations 2 and 5, so that Equation 5 could be integrated numerically to show how the flow rate difference and the retort ammonia concentration would be expected to change with time for a fixed input flow rate of ammonia.

In order to provide this simulation of the operation of the nitriding process control method of this invention, it was assumed that the input flow rate would be adjusted every three minutes in accordance with the measured retort ammonia concentration and flow rate difference to a value that, according to Equation 5, would cause the ammonia concentration to shift toward the desired value of $X^*=0.85$ at an initial rate proportional to its deviation from that value. In particular, each new value of $V_{in}$ was chosen using $\dot{X}^*=B(X^*-X)$ with a value of $B=40\ hr^{-1}$, i.e., a rate that would correct the deviation in $1\frac{1}{2}$ minutes if nothing changed. The gas flow rate differences, the sequence of selected input gas flow rates, and the resulting retort ammonia concentrations for a period of 90 minutes expected to result are shown by Curves A, B, and C, respectively, of FIG. 2. As a result of both the ammonia concentration dependence of $j_{NH3}$ and the assumed time-dependence of K'S, the concentration correction rate would not be expected to remain constant during the 3-minute intervals between input flow rate adjustments. Nevertheless, the ammonia concentration in the retort should be maintained very close to the desired level of $X^*=0.85$.

EXAMPLE III

Figure 3:
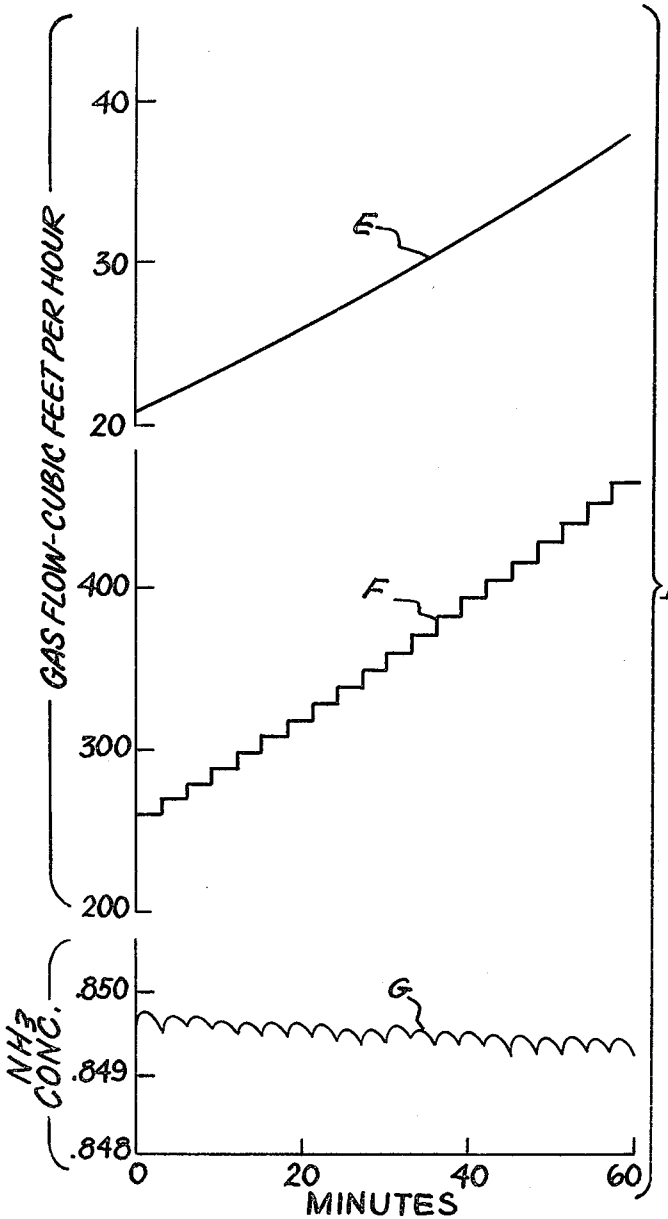

This example illustrates how it is proposed to control the nitriding process in accordance with this invention to maintain the retort gas ammonia concentration in close approximation to its desired value despite changes in the ammonia dissociation rate as a result of retort temperature changes. For purposes of this example, it will be assumed that the rate of ammonia dissociation follows the relationship given in Equations 6, 6a and 7, that the time-dependence of K'S assumed for EXAMPLE II continues in $K_o$ of equation 7 and that the temperature-dependence is given by Equation 7 with an activation energy Q of 10,000 cal/mole. Starting at the 90-minute termination of EXAMPLE II, (i.e., a new zero time in FIG. 3) it is assumed that the temperature is increased from 900° F. (755° K.) to 950° F. (783° K.) at a rate of 50° F. (27.8° K.) per hour. The calculation procedure and control strategy are the same as those used in EXAMPLE II. Curves E, F and G, respectively, of FIG. 3 show the gas flow rate differences, the sequence of selected input flow rates, and the retort ammonia concentration expected to result for the 60-minute period of the temperature ramp. Again, it is seen that the ammonia concentration in the retort should be maintained very close to the desired level of $X^*=0.85$ by the practice of this process.

EXAMPLE IV

This example illustrates how it is proposed to control the nitriding process in accordance with this invention to rapidly bring about a desired change in the retort gas ammonia concentration, with little overshoot of the desired new value. In addition, this example intended to simulate operation of the control system by adjustment of the ammonia concentration in the input gas, rather than its flow rate. For purposes of this example, it will be assumed that the catalytic activities of the steel and other metal surfaces in the retort have stabilized, and the retort gas ammonia concentration is steady at $X=0.85$, with an input flow rate of 900 cubic feet per hour of pure ammonia. It is further supposed that it is desired to reduce the ammonia concentration in the retort to approximate a value of $X^*=0.25$ for the later stages of the nitriding process, and to establish and maintain an input gas flow rate of 100 cubic feet per hour, for example, to assure sufficient flow for adequate mixing of the retort gas. The input gas ammonia concentration is assumed to be adjusted by dilution with externally dissociated ammonia. The retort temperature is assumed to be 950° F. (783° K.), and its volume 100 cubic feet. The assumption is that the input gas ammonia concentration is adjusted every three minutes in accordance with the same deviation-correcting strategy as in EXAMPLES II and III, i.e., such that the initial rate of change of retort ammonia concentration will be $\dot{X}^*=40(X^*-X)$, or as near to that rate as possible with an input gas flow rate of 100 cubic feet per hour. The calculation method is the same as that used in EXAMPLES II and III. The resulting course of the gas flow rate difference, the sequence of selected input gas ammonia concentrations, and the course of the resulting retort ammonia concentration are shown in FIG. 4 by Curves H, J and K, respectively.

What is claimed is:

1. In the process of nitriding, wherein influent gas flow containing ammonia continuously enters a nitriding chamber to flowingly contact at least one steel body at elevated temperature therein whereby ammonia is caused to dissociate and effluent gas continuously exits said chamber; the method for controlling the nitriding process in said chamber comprising the steps of:
   (1) measuring the influent gas flow rate,
   (2) measuring the effluent gas flow rate,
   (3) measuring the current rate of dissociation of ammonia in said chamber based upon the difference between said flow rates and
   (4) changing (x) the rate of influent gas flow, (y) the concentration of ammonia in the influent gas flow or (z) both (x) and (y) as required to adjust the mole fraction of ammonia to the value to be maintained in said chamber.

2. The method of claim 1 wherein adjustment of the mole fraction of ammonia in the nitriding chamber is accomplished by changing the composition of the influent gas flow.

3. The method of claim 2 wherein adjustment of the mole fraction of ammonia in the nitriding chamber is accomplished by changing the concentration of ammonia in the influent gas flow.

4. The method of claim 1 wherein adjustment of the mole fraction of ammonia in the nitriding chamber is accomplished by changing the rate of flow of the influent gas.

5. The method of claim 1 wherein adjustment of the mole fraction of ammonia in the nitriding chamber is accomplished by changing both the composition and the rate of flow of the influent gas.

6. The method of claim 1 wherein adjustment of the mole fraction of ammonia in the nitriding chamber is performed intermittently.

7. The method of claim 1 wherein the measuring of the flow rates of the influent and effluent gasses is substantially continuous.

8. The method of claim 1 wherein the mole fraction of ammonia in the nitriding chamber changes with time during conduct of the process.

9. The method of claim 1 wherein the mole fraction of ammonia in the nitriding chamber is adjusted in according with the following relationship:

$$(X_o - X)\dot{V}_{in} = (1 + X)\Delta + \frac{T_a V_r}{T_r}\left[\dot{X}^* - (1 + X)\frac{\dot{T}_r}{T_r}\right]$$

wherein:

X = measured concentration of ammonia in said chamber;

$X_o$ = concentration of ammonia in the influent gas flow;

$\dot{X}^*$ = selected rate of approach of X to the composition of ammonia to be maintained in the nitriding chamber;

$\dot{V}_{in}$ = rate of flow of the influent gas;

$V_r$ = volume of gas contained in said nitriding chamber;

$T_a$ = absolute temperature of the gas at locations where the rates of flow of the influent and effluent gases are measured;

$T_r$ = absolute temperature of the atmosphere in said nitriding chamber;

$\dot{T}_r$ = rate of change of $T_r$; and $\Delta$ = rate of flow of the effluent gas minus $V_{in}$ to provide the mole fraction of ammonia to be maintained in said chamber.

10. The method of claim 7 wherein adjustment of the mole fraction of ammonia in the nitriding chamber is performed substantially continuously.

11. The method of claim 9 wherein $\dot{X}^*$ substantially follows the relationship $$\dot{X}^* = B(X^* - X)$$

in which

B is a constant and $X^*$ is the composition of ammonia to be maintained in the nitriding chamber.

* * * * *